United States Patent [19]

Yamamoto

[11] Patent Number: 4,873,607

[45] Date of Patent: Oct. 10, 1989

[54] METHOD OF AND APPARATUS FOR CONTROLLING THE OPERTION OF ELECTROMAGNETIC SWITCHES

[75] Inventor: Kyohei Yamamoto, Hyogo, Japan

[73] Assignee: Mitsubishi Denki Kabushiki Kaisha, Tokyo, Japan

[21] Appl. No.: 159,717

[22] Filed: Feb. 24, 1988

[30] Foreign Application Priority Data

Feb. 25, 1987 [JP] Japan ..... 62-26984[U]
Feb. 25, 1987 [JP] Japan ..... 62-41848[U]

[51] Int. Cl.[4] ..... H01H 47/00
[52] U.S. Cl. ..... 361/210; 123/179 R
[58] Field of Search ..... 361/154, 210; 123/179 R; 290/38 R

[56] References Cited

U.S. PATENT DOCUMENTS 4,114,184 9/1978 Stampfli ..... 361/210
4,418,289 11/1983 Mortenson ..... 361/154
4,452,210 6/1984 Sasayama et al. ..... 361/154

OTHER PUBLICATIONS

Japanese Patent Public Disclosure No. 101672/1986.

*Primary Examiner*—L. T. Hix
*Assistant Examiner*—David M. Gray
*Attorney, Agent, or Firm*—Wolf, Greenfield & Sacks

[57] ABSTRACT

Techniques for controlling the operation of an electromagnetic switch are provided. The current supplied to an exciting coil of the electro-magnetic switch is gradually increased until the contacts of the switch are closed. After the closure of the contacts, the exciting current is reduced to the minimum level needed to hold the contacts closed.

6 Claims, 6 Drawing Sheets

METHOD OF AND APPARATUS FOR CONTROLLING THE OPERTION OF ELECTROMAGNETIC SWITCHES

BACKGROUND OF THE INVENTION

1. Field of the Invention

This invention relates generally to control of the operation of an electro-magnetic switch and, more particularly, to a method of and apparatus for controlling the supply of current to an exciting coil of an electro-magnetic switch in response to movements of a plunger.

2. Description of the Prior Art

A practical example of a conventional electro-magnetic switch is shown in FIG. 1. In FIG. 1, the supply of power to a load device 2 is controlled by closing and opening the electro-magnetic switch 3. The switch 3 is provided with a normally open contact circuit constituted by a pair of fixed contacts 3*a*, 3*b* and a movable contact 3*c*. The switch 3 also has an exciting coil 3*d* connected to a battery 1 through an operating switch 4 so that the exciting coil 3*d* can be energized to attract a plunger 5 in the direction indicated by an arrow in the drawing for movement of the movable contact 3*c*, thereby to cause the latter to abut against the fixed contacts 3*a*, 3*b* in opposition to the resilience of a return spring 3*e* and hold the switch 3 in its closed position.

The operation of the circuit shown in FIG. 1 is as follows. When the operating switch 4 is closed, the exciting coil 3*d* of the electro-magnetic switch 3 is excited to attract the plunger 5. Consequently, the movable contact 3*c* abuts against the pair of fixed contacts 3*a*, 3*b* in opposition to the action of the return spring 3*e* so that the power is supplied from the battery 1 through the electromagnetic switch 3 to the load device 2.

When the operating switch 4 is open, the exciting coil 3*d* is de-energized so that the movable contact 3*c* is returned under the action of the return spring 3*e* to the position shown in FIG. 1 to interrupt the connection between the battery 1 and the load device 2.

The conventional electro-magnetic switch is arranged in the manner mentioned above and, especially when it is used to interrupt a relatively large amount of current flow, the return spring has to provide a considerable spring force. Additionally, if the switch is provided in a place that is subjected to vibration, it will also be necessary for the return spring to be designed to generate sufficient spring force to prevent any malfunction of the contact. In any case, a large amount of current must be employed in operating the exciting coil and a large type of operating switch will also be needed. Moreover, the level of power consumption attributable to the exciting coil is high and this means that the switch device must be large in size due to thermal restrictions and the overall system is therefore large too which results in reduced electrical efficiency.

In FIG. 2, a curved line $K_1$ or $f_1-f_2$ shows variations in the attracting force of the plunger 5 with respect to the position of the plunger as it moves away from its rest position (point A) to its fully magnetically attracted position (point O). A line $H_1$ or $P_1-P_2$ also shows variations in the load of the return spring 3*e*, and a point B is the position of the plunger at the time when the contact closes. As is clear from FIG. 2, the force with which the plunger is attracted increases substantially along a quadratic curve from the rest position (point A), whereas the load of the return spring increases linearly in accordance with the spring constant.

In order for the plunger to be successfully attracted, it is necessary to establish the following condition at each of the positions A, B and O.

(Attractive force applied to plunger) > (Load of return spring)

Even if an appropriate spring load $P_1$ is determined in consideration of vibration or the like occurring at the point A and an exciting coil is designed to satisfy the condition of $f_1 > P_1$ extremely unequal conditions of $f_3 >> P_3$ and $f_2 >> P_2$ are caused at the points B and O to generate excessively large attractive forces, thereby increasing heat generation in the exciting coil and producing undesirable noises at the end of the attraction. Additionally, in the case of the load device 2 being a starter motor of a vehicle or the like utilizing the movement of the plunger 5, the accelerated movement causes various adverse factors.

In designing the plunger, it is also necessary to make sure that the plunger will exert an adequate attractive force even when the temperature of the exciting coil is increased to a certain extent (i.e., the resistance of the coil is increased), but an excessively large attractive force will result in an increased level of power consumption when the temperature of the coil is low (i.e., the resistance of the coil is relatively small).

Referring to FIG. 3, another practical example of the conventional electro-magnetic switch is shown which is incorporated in a control device for a starter motor. The starter motor 11 is of an electro-magnetically forced-in type and comprises a switch section 11*a* and a motor section 11*b*. A battery 12 is connected at its positive terminal through a starter switch 13 to a junction between a current coil 16 and a voltage coil 17, and is also to a fixed contact 14*a* of a normally open electro-magnetic switch 14, and the negative terminal of the battery 12 is connected to the ground. A plunger 15 is provided for operating a movable contact 14*a* of the Switch 14. Another fixed contact 14*c* thereof is connected to the current coil 16 and also to a brush 19*a* provided on a body 18 of the starter motor. The brush 19*a* is connected to an armature 19 of the motor body 18 and another brush is grounded. The other end of the voltage coil 17 is also grounded. A pinion 20 is provided to be movable in the axial direction of the motor body 18, and one end 21*b* of a lever 21 is engaged with the pinion 20. The other end 21*a* of the lever 21 is engaged with the plunger 15 in a manner not shown and is pivotably provided about a pivot 21*c* mounted on a lever spring 22. The pinion 20 is moved in the rightward direction and brought into tooth-to-tooth engagement with a ring gear 23 of the engine (not shown) when the plunger 15 is attracted in the direction of the arrow.

The operation of the switch control apparatus arranged as mentioned above is as follows. When the starter switch 13 is first turned on, the current and voltage coils 16 and 17 are connected to the battery 12 and current flows through the coils. Thus, the plunger 15 is attracted in the direction of the arrow and the movable contact 14*c* of the electro-magnetic switch 14 is brought into abutment with the fixed contacts 14*a* and 14*b* thereof. At this time, said other end 21*a* of the lever 21 is moved in the leftward direction as viewed in the drawing and said one end 21*b* is moved in the rightward direction to move the pinion 20 towards the ring gear 23. The armature 19 is energized and rotated by the closure of the switch 14, and the pinion 20 is brought into engagement with the ring gear 23 to transmit the rotation of the armature 19 to the latter, thereby starting the engine. In this event, the lever spring 22 serves to facilitate the engagement of the pinion 20 with the ring gear 23 when their teeth are brought into abutment with each other.

In such a switch control device for a starter motor, the attractive force applied to the plunger 15 is increased substantially along a quadratic curve as shown by a solid line $K_2$ in FIG. 4, from a value $f_1'$ to a value $f_2'$ during the period of time from turning on of the starter switch 13 at the point A to the point of full attraction of the plunger (Point O). Since the voltage of the battery is abruptly applied across the exciting coil, the plunger is displaced by a strong force so that the lever 21 that is engaged with the plunger 1 causes the pinion 20 to violently strike against the ring gear 23 which involves the risk of damaging the pinion and/or the ring gear 23. Since the magnetomotive force is determined by the value of the current multiplied by the number of turns of the coil, the applied voltage rises to allow an appropriate amount of current to flow for the attraction when the temperature of the coil is high. Since conventional devices have been designed to take this into consideration, the attractive force becomes excessive under low temperature conditions. Moreover, the abrupt displacement of the plunger causes the lever spring 22 to be compressed such as to displace the pivot 21*c* rather than to move the pinion 20, and thus the electro-magnetic switch closes early causing an undesirable increase in rotation of the pinion 20 and thereby making it difficult for the subsequent engagement of the pinion 20 with the ring gear 23 to be achieved.

SUMMARY OF THE INVENTION

It is, therefore, an object of the present invention to provide an electro-magnetic switch device which is compact and light and in which the displacement of the plunger is smooth and the level of power consumption is low.

Another object of the present invention is to provide an apparatus for controlling a switch for a starter motor with a compact and light structure which is capable of ensuring smooth engagement of the pinion with the ring gear, and lowering the level of heat generation in the exciting coil, thus in turn reducing the level of power consumption.

According to the present invention, the above-mentioned objectives can be achieved by an electro-magnetic switch device comprising a plurality of exciting coils for generating an appropriate amount of attractive force for closing a contact circuit, the exciting coils being connected to one another in parallel, and a control means for energizing the exciting coils in sequence to gradually increase the attractive force until closure of the contact circuit is achieved, and after the closure continuing the energization of an exciting coil or coils merely at the level necessary to maintain the closure of the contact circuit.

With this arrangement, the parallel division of the exciting coil allows the current level allotted to each of the coils to be reduced. Moreover, because of the gradual increase in the attractive force, the attraction is achieved with a lower level of power consumption and commences with an attractive force which is greater than the load of the return spring which provides for smooth displacement of the plunger. Furthermore, after the closure of the contact circuit, an exciting coil or coils is/are energized merely at the level necessary to maintain such closure of the contact circuit and the level of current passing through the coil or coils during the closure of the contact circuit is reduced.

According to the present invention, there is also provided an apparatus for controlling a switch for a starter motor, the apparatus comprising a control means operable so that the current flowing through an exciting coil of an electro-magnetic switch for a starter motor of an electro-magnetically forced-in type is gradually increased until the electro-magnetic switch circuit is closed after the starter switch has been turned on and after the electro-magnetic switch is closed, the current is reduced.

With this arrangement, during the gradual increase in the amount of current flowing through the exciting coil the switch initiates the attraction at the time when the current becomes sufficient to do so, thereby achieving a smooth movement of the pinion into smooth engagement with the ring gear. After initial closure of the switch circuit, the current is controlled to retain the closure of the switch and thus the level of heat generation therein is reduced.

DETAILED DESCRIPTION OF THE PREFERRED EMBODIMENTS

Figure 5:
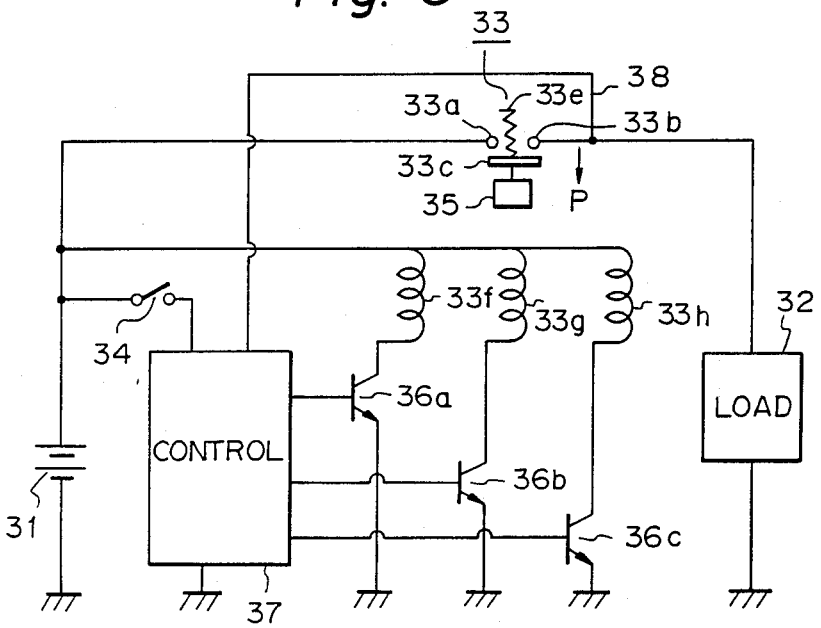
FIG. 5 is a circuit diagram of an embodiment of the electro-magnetic switch device in accordance with the present invention.

In FIG. 5 which represents a circuit diagram of an embodiment of the electro-magnetic switch device in accordance with the present invention, an electro-magnetic switch 33 is provided between a battery 31 serving as a power source and a load device 32, the switch being provided with a normally open contact circuit constituted by a pair of fixed contacts 33*a*, 33*b* and a movable contact 33c which is provided on a plunger 35. The switch also has exciting coils 33f, 33g and 33h disposed in parallel to one another and connected to the battery 31, and the exciting coils 33f, 33g, 33h are connected in series with transistors 36a, 36b, 36c, respectively, for conducting and interrupting the flow of current therethrough. A return spring 33e is provided for urging the movable contact 13c in the direction P shown. A control device 37 receives an input signal from an operating switch 34, drives and energizes the transistors 36a, 36b, 36c in sequence and also receives through a signal line 38 an input signal indicating the closure of the contact circuit to control the drive of the transistors 36a, 36b, 36c whereby control is effected for maintaining the drive of a transistor or transistors for an exciting coil or coils which is/are participating in holding the contact circuit in its closed condition and suspending the drive of the remaining transistor or transistors.

Figure 5A:
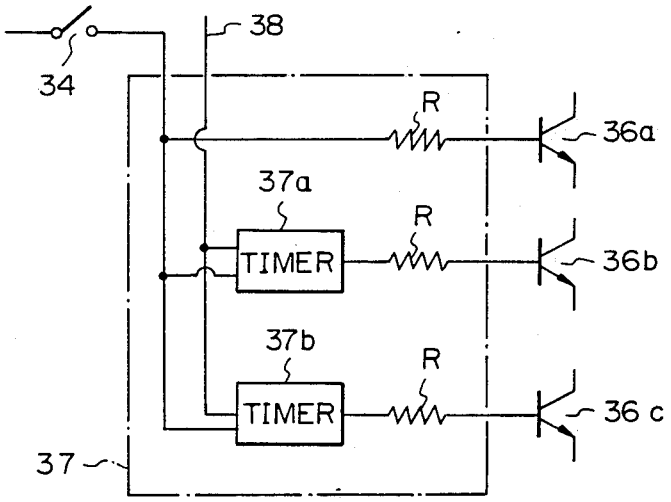
FIG. 5A is a circuit diagram of an example of the control device shown in FIG. 5.

Referring to FIG. 5A, a schematic diagram of an example of the control device 37 is shown. The control device 37 comprises timers 37a and 37b and base resistors R. The timer 37a, in response to the turn on operation of the switch 34, provides an output after a predetermined delay, for example 10 milliseconds after the closure of the switch 34, to supply a base current for the transistor 36b through the resistor R. Also, the timer 37b provides an output after a predetermined delay, for example 20 milliseconds after the turn-on operation of the switch 34, to cause the transistor 36c to turn on. The timers 37a and 37b are deenergized when the line 38 signals the closure of the contacts 33a, 33b and 33c. Thus, when the switch 34 is closed, the transistor 36a is first turned on to excite the coil 33f, and then the coils 33g and 33h are sequentially excited. After the switch 33 is closed, the coils 33g and 33h are deenergized and only the coil 33f is kept excited.

Figure 1:
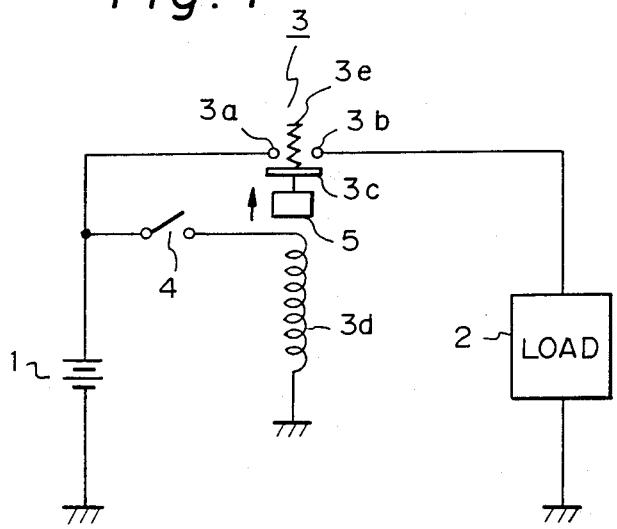
Fig. 1 (PRIOR ART)
FIG. 1 is a circuit diagram of a conventional electro-magnetic switch device.
Figure 2:
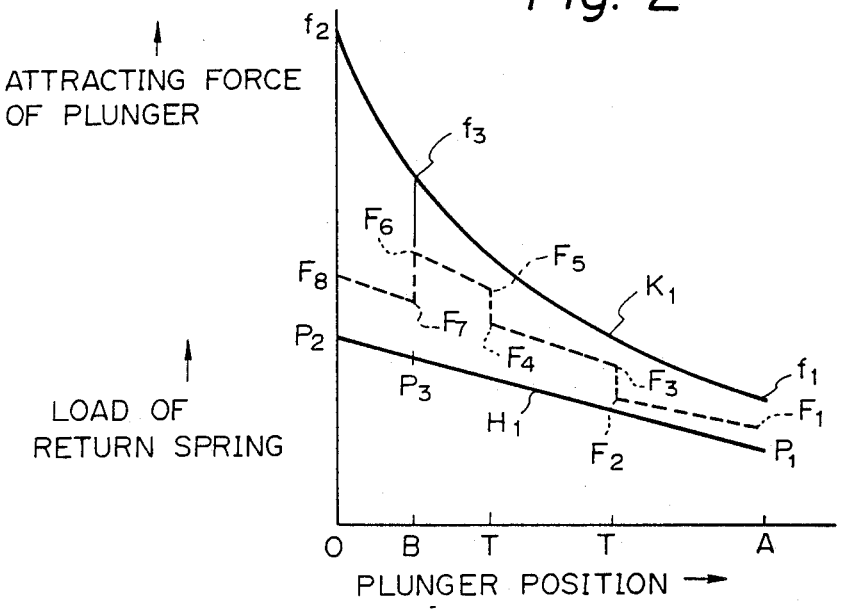
FIG. 2 is a graph showing the interrelationships between the position of the plunger, the force for attracting the plunger and the load of the return spring of the electro-magnetic switch devices in accordance with the present invention and the prior art.

The operation of the electro-magnetic switch device arranged as described above will next be described with reference to FIG. 2. When the operating switch 34 is turned on, the control device 37 first energizes and drives the transistor 36a to direct the current to the exciting coil 33f. In FIG. 2, the point A corresponds to the time at which the operating switch 34 is turned on and $F_1$ is the force for attracting the plunger 35 at this time. The control device 37 then turns on the transistor 36b at the point $T_1$ in addition to the transistor 36a to direct the current to the exciting coils 33f and 33g so that the force for attracting the plunger increases from $F_2$ to $F_3$ at the point $T_1$. The control device 37 also turns on the transistor 36c at the point $T_2$ to direct the current to all of the exciting coils 33f, 33g and 33h, thereby increasing the attractive force from $F_4$ to $F_6$. In this manner, the attractive force is gradually increased from $F_1$ to $F_6$ and the plunger 35 is moved against the resilient force of the spring 33d in the opposite direction to that indicated by the arrow P, thereby causing the movable contact 33c to abut against the fixed contacts 33a, 33b to close the contact circuit therebetween. Thus, power is supplied from the battery 31 to the load device 32 and at the same time the control device 37 is supplied with the input signal through the line 38 indicating the closure of the contact circuit and is operated to control the transistors 36a, 36b, 36c so that a transistor (for example, transistor 36a) whose use is necessary to hold the contact circuit in the closed condition is held its on-condition and the remaining transistors (for example, transistors 36b and 36c) are turned off. The dotted line $F_7$–$F_8$ shows the force for attracting the plunger after the closure of the contact circuit. At the point B the contact circuit is closed, only the transistor 36a being driven and the attractive force being decreased from $F_6$ to $F_7$. Thereafter the attractive force is increased as the plunger moves towards the point O at which the plunger attraction is completed. In contrast with the fact that in the prior art the force for attracting the plunger is increased quadratically, with the present invention it is increased in a stepped fashion and smooth displacement of the plunger 35 can be achieved. In particular, in a case where the load device 32 is a starter motor, the movement of the pinion (FIG. 7) driven by the operation of the plunger 35 is smoothly achieved without any risk of accelerated motion of the plunger 35. Although the condition $F_1 > P_1$ has been described above, a condition equivalent to $F_1 < P_1$ may be encountered when the temperature of the coils is raised and the necessary attractive force cannot be produced solely by the first exciting coil. Even in this condition, however, the control device 37 operates to energize the exciting coils 33f, 33g, 33h in sequence and a sufficient attractive force to overcome the load of the return spring will be produced by additionally energizing one or both of the second and third exciting coils in order to commence the attracting operation. It is, therefore, possible to achieve a smooth attraction operation and reduce the level of power consumption. Furthermore, after closure of the contact circuit, it is only necessary to maintain the minimum level of energization of the exciting coils necessary to establish the condition of $F_7 > P_3$ at the time of closing the contact circuit (point B). This reduces heat generation in the coils, enhances electrical efficiency and allows for a compact structure.

Moreover, the parallel provision of the exciting coils 33f, 33g, 33h makes it possible to reduce the amount of current flowing through the respective exciting coils and this makes it possible to use a smaller and cheaper type of transistor.

Figure 6:
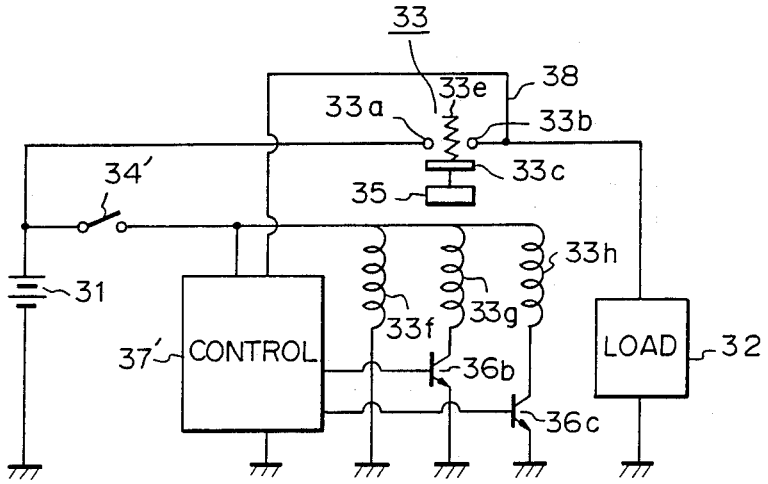
FIG. 6 is a circuit diagram of another embodiment of the electro-magnetic switch device in accordance with the present invention.

Another embodiment of the present invention is shown in FIG. 6 in which the current to be directed to the exciting coils 33f, 33g and 33h flow through an operating switch 34' and so the switch 34' must be of a larger type capable of bearing higher currents than that of the operating switch 34 of FIG. 5 embodiment, but there is an advantage in that the transistor 36a of FIG. 5 can be omitted to reduce the number of transistors to be used. A control device 37' may be easily implemented utilizing the circuit shown in FIG. 5A. The other parts and devices are similar to those of FIG. 5 and are designated by the same reference characters, and further description thereof is omitted.

As described above, the present invention brings about the effect that the plurality of divided exciting coils is energized in sequence to gradually increase the attractive force until the contact circuit closes, and thereafter only the exciting coil or coils necessary to hold the contact circuit in its closed condition is/are energized, displacement of the plunger can be achieved smoothly, the level of power consumption and total heat generation of the exciting coils can be reduced, and thus devices can be produced which are compact and in which the electrical efficiency and reliability can be enhanced.

Figure 3:
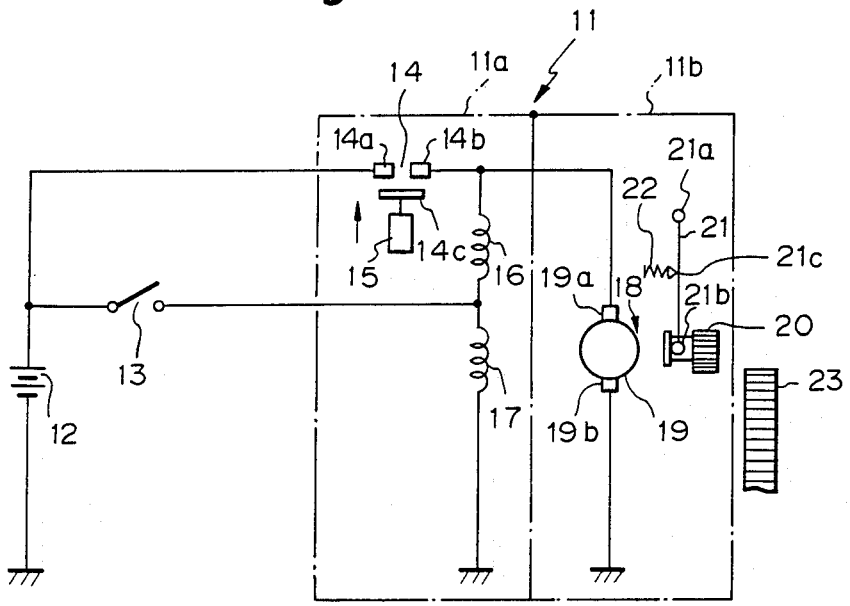
Fig. 3 ( PRIOR ART )
FIG. 3 is a circuit diagram of a conventional apparatus for controlling a switch for a starter motor.
Figure 7:
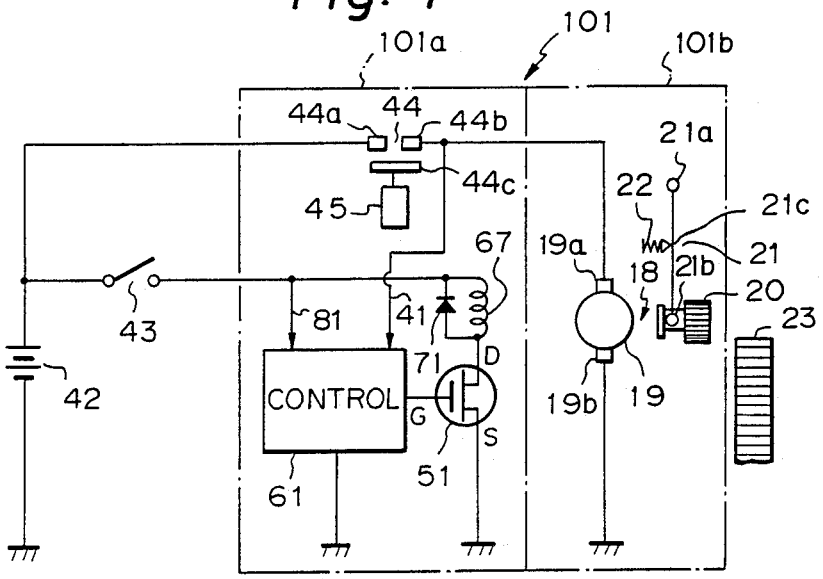
FIG. 7 is an embodiment of an apparatus for controlling a switch for a starter motor in accordance with the present invention.

Referring now to FIG. 7, there is shown a circuit diagram of an apparatus for controlling a switch for a starter motor in accordance with the present invention in which the starter motor 101 comprises a switch section 101a and a motor section 101b, the latter being arranged in a similar manner to the motor section 11*b* of the conventional device (FIG. 3). An exciting coil 67 is connected at its one end through an operating switch 43 to a battery 42 and also at the other end to the drain terminal of a power MOS FET 51. A starter signal 81 is input to a control circuit 61 from the operating switch 43 followed by a signal 41 indicating the closure of the contact circuit from an electro-magnetic switch 44, thereby to control the MOS FET 51. The source of the MOS FET 51 is grounded. The counter electromotive force of the exciting coil 67 is absorbed by a diode 71. The remainder of the arrangement is similar to the conventional device (FIG. 3) and the same reference characters are employed for these portions, further description thereof being omitted.

Figure 7A:
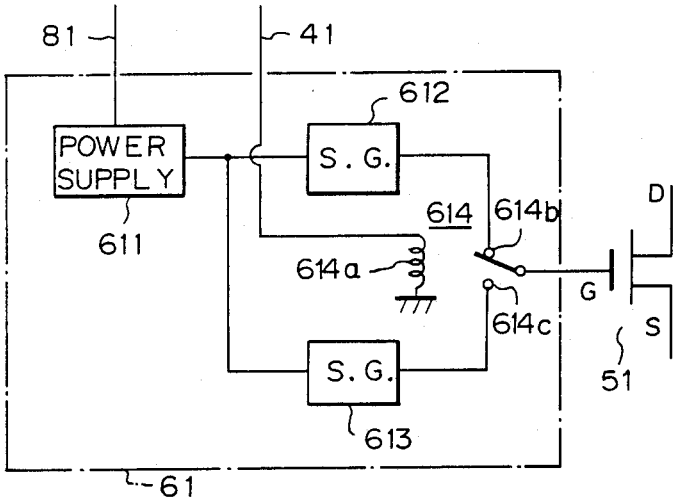
FIG. 7A is a circuit diagram of an example of the control circuit shown in FIG. 7.

Referring to FIG. 7A, a schematic diagram of an example of the control circuit 61 is shown. In FIG. 7A, a power supply circuit 611 drives signal generators 612 and 613 in response to the starter signal 81 supplied upon closing of the operating switch 43. A switch 614 switches the gate electrode G of the FET 51 between the signal generators 612 and 613 through contacts 614*b* and 614*c*, respectively, in response to the contact closure indicating signal 41 which is supplied to a coil 614*a* of the switch 614. The signal generator 612 produces pulse signals with its duty factor gradually increased as shown from a point s to a point m in FIG. 9(*a*). On the other hand, the signal generator 613 produces pulse signals with its duty factor constant as shown from the point m to a point e in FIG. 9(*a*). Thus, when the operating switch 43 is closed, the signal generator 612 supplies the gate G of the FET 51 with pulse signals through the contact 614*b* , and the duty factor of the pulses is gradually increased. When the switch 44 is closed, the coil 614*a* is excited by the current supplied through the line 41 to cause the contact 614*c* to be connected to the gate G of the FET 51. After that, the signal generator 613 provides the gate G with pulse signals with its duty factor constant.

Figure 9:
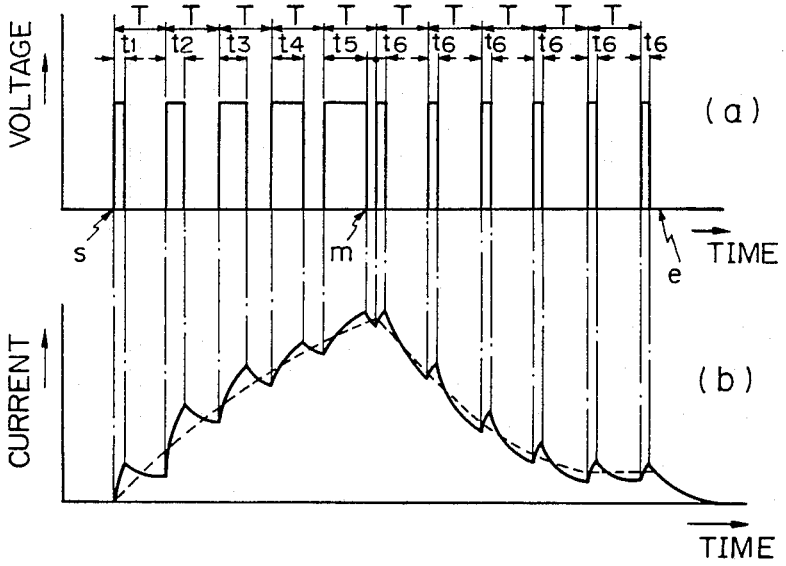
FIG. 9 is an explanatory diagram showing the control of the apparatus for controlling a switch for a starter motor.

The operation of the apparatus for controlling the switch arranged as described above will now be described. When the operating switch 43 closes, the starter signal 81 is inputted into the control device 61 which, in turn, turns on the MOS FET 51 to energize the exciting coil 67 through the signal generator 612. FIGS. 9(a) and (b) show the on/off operation of the MOS FET 51 and variations in the current flowing through the exciting coil 67, respectively. In the drawings, the point S shows the time of initiating the control and the MOS FET 51 is turned on and off as shown to increase the duty factor as the time elapses ($t_1/T<t_2/T<t_3/T< \ldots$). Accordingly, the current flowing through the exciting coil 67 is also gradually increased correspondingly to gradually increase the electromotive force thereof (the mean amount of the current being shown by a dotted line in FIG. 9(*b*)). At the point m, the movable contact 44*c* is contacted with the fixed contacts 44*a* , 44*b* to close the electro-magnetic switch 44, and thereafter the operation with the duty factor being $t_5/T$ is performed to obtain the holding current, and the control is ceased when the operating switch 43 is open at the point e. As a result, the current through the exciting coil 67 becomes reduced from the point m or after the closure of the contact circuit.

Figure 8:
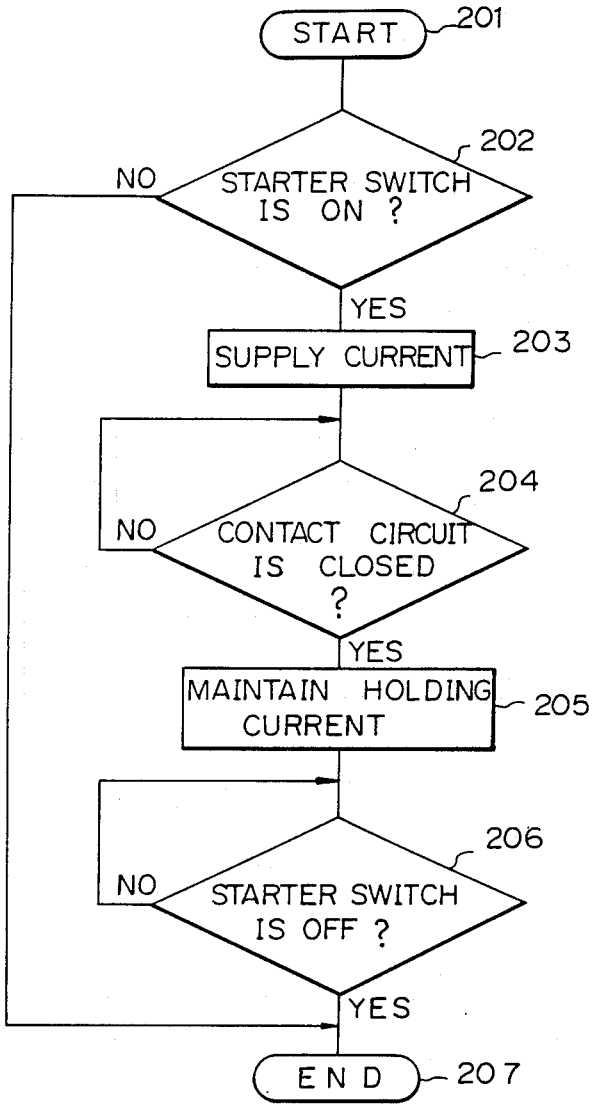
FIG. 8 is a flow chart showing the operation of the apparatus shown in FIG. 7.

FIG. 8 is a flow chart of the control process mentioned above. The process first proceeds from the initiating step 201 to step 202 and, if the starter switch 43 is turned on, then to step 203 in which the control for gradually increasing the flow of current through the exciting coil 67 is performed. If the contact circuit of the electro-magnetic switch 44 is closed in step 204, the process then proceeds to step 205 to maintain the holding current and to step 206 where it is checked to see if the starter switch 43 is turned off. If so (the engine having been normally started up), the process proceeds to step 207 in which the control operation is terminated. If the starter switch 43 is not turn on in step 202, the process proceeds directly to step 207 and no control is performed. In cases where the contact circuit of the electro-magnetic switch 44 is found to be open in step 204 and the starter switch 43 turned on in step 206, the process does not proceed to the subsequent step and the cycle is repeated as explained above.

Figure 4:
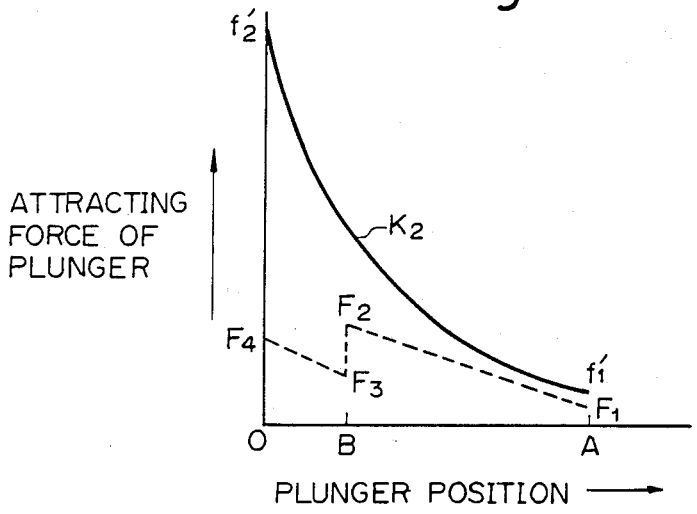
FIG. 4 is a graph showing the interrelationship between the position and force for attracting the plunger of the apparatus for controlling a switch for a starter motor in accordance with the present invention and the prior art.

FIG. 4 shows the relationship between the position of the plunger and the attractive force and dotted line $F_1$–$F_4$ shows the case of the embodiment described above, the point A being the rest position (normal position of the plunger when the starter switch 43 is not being operated), the point B being the position where the contact circuit of the electro-magnetic switch 44 is closed and the point O being the position where the attraction is completed. In this manner, the plunger 45 is moved with the minimum force necessary for attraction (point $F_1$) to reach the point $F_2$ as the current gradually increases to provide the holding current (point $F_3$) and then to the point $F_4$ at which the attraction is terminated. Consequently, the switch section 101*a* commences the attracting operation at the time when the required amount of current flows for the attraction so that the movement of the pinion 20 is smoother than in the conventional device and there is no problem at the time of starting the motor due to the compression of the lever spring 22. Also smooth engagement can be established between the pinion 20 and the ring gear 23 and heat generation in the switch is reduced because only the holding current is maintained after the closure of the contact circuit of the electro-magnetic switch 44.

In the above-described embodiment, the period of time T is set at a constant value, but it may be varied and the time period $t_5$ after the closure of the contact circuit of the electro-magnetic switch may also be varied. The control device may also be arranged integrally with the switch so that further functions can be added by changing the switch. Furthermore, if control is performed such that the holding current is obtained after a predetermined period of time has elapsed from the turning on of the starter switch 43, the signal line 41 for indicating the closure of the contact circuit can then be omitted.

As described above, since the present invention is so arranged that the current for the exciting coil is gradually increased from the time when the starter switch is turned on to the time when the contact circuit of the electro-magnetic switch is closed, and is reduced after the closure thereof, the invention is able to bring about the following effects.

(1) Smooth displacement can be achieved so as to prevent the pinion and ring gear from being damaged, and the operation is initiated with the minimum necessary amount of current so as to reduce the level of power consumption.

(2) The rate of rotation of the pinion upon engagement is so low that smooth engagement is ensured.

(3) The reduction in the flow of current after closure of the contact circuit of the electro-magnetic switch lowers the level of heat generation in the exciting coil and allows for a compact and light-weight design.

(4) The gradual increase and decrease in current makes it possible to use thinner and cheaper wires or cables for the circuit.

Although the present invention is described with reference to certain embodiments, it will be apparent to one skilled in the art that various alterations and modifications can be made to the embodiments described.

What is claimed is:

1. Electromagnetic switch apparatus for connecting a load device to a power source, said electromagnetic switch apparatus comprising:

a contact connected electrically in series between said load device and said power source, said contact having an open position in which said load device is not connected to said power source and said contact having a closed position in which said load device is connected to said power source;

means connected to said contact for moving said contact to said closed position, said moving means including a plurality of exciting coils connected in parallel, said coils, when energized, generating a force to move said contact to said closed position;

energizing apparatus operable to energize each of said plurality of exciting coils sequentially so that the generated force is increased in steps until said contact is moved to said closed position; and release apparatus responsive to said contact being moved to said closed position to de-energize at least one of said plurality of exciting coils.

2. An electro-magnetic switch as set forth in claim 1, wherin the load device is a starter motor.

3. An electro-magnetic device as set forth in claim 1 or 2, wherein said energizing apparatus comprises a semi-conductor element.

4. Electromagnetic switch apparatus for electrically connecting a load device to a power source, said switch device comprising:

an operating switch operable to actuate said electromagnetic switch apparatus;

a solenoid switch electrically connected in series between said power source and said load device, said solenoid switch being operable to complete an electrical circuit between said power source and said load device and said solenoid switch comprising a plurality of exciting coils;

a plurality of electronic control switches, each of said plurality of control switches being operable to connect one of said exciting coils across said power source;

a control device responsive to an actuation of said operating switch to sequentially operate said control switches to allow current to flow successively through each of said plurality of exciting coils; and a release device responsive to said contact being moved to said closed position to de-energize at least one of said plurality of control switches.

5. An electro-magnetic switch device as set forth in claim 4, wherein each of said plurality of exciting coils have a first terminal connected to the power source by means of said operating switch.

6. An electromagnetic switch device as set forth in claim 4, or 5, wherein said electronic control switches comprise transistors.

* * * * *

UNITED STATES PATENT AND TRADEMARK OFFICE

CERTIFICATE OF CORRECTION

PATENT NO. : 4,873,607

DATED : October 10, 1989

INVENTOR(S) : Kyohei Yamamoto

It is certified that error appears in the above-identified patent and that said Letters Patent is hereby corrected as shown below:

On the title page, item [54] and in column 1, lines 2-4, please correct the title to read --METHOD OF AND APPARATUS FOR CONTROLLING THE OPERATION OF ELECTROMAGNETIC SWITCHES--.

Signed and Sealed this

Sixteenth Day of April, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,873,607

DATED : October 10, 1989

INVENTOR(S) : Kyohei Yamamoto

It is certified that error appears in the above-identified patent and that said Letters Patent is hereby corrected as shown below:

ON TITLE PAGE: Item [30] please correct "62-41848(U)" to -- 62-41848(P) --.

Signed and Sealed this

Seventh Day of July, 1992

*Attest:*

DOUGLAS B. COMER

*Attesting Officer*

*Acting Commissioner of Patents and Trademarks*